US005913774A

United States Patent [19]

Feddema

[11] Patent Number: 5,913,774

[45] Date of Patent: Jun. 22, 1999

[54] HOSPITAL BED MATTRESS WITH AN ADJUSTABLE FIRMNESS PERINEAL END SECTION

[75] Inventor: Mark S. Feddema, Kalamazoo, Mich.

[73] Assignee: Stryker Corporation, Kalamazoo, Mich.

[21] Appl. No.: 08/951,241

[22] Filed: Oct. 16, 1997

[51] Int. Cl.[6] ..... A61G 7/015

[52] U.S. Cl. ..... 5/618; 5/613; 5/602; 5/615

[58] Field of Search ..... 5/617, 602, 613, 5/615, 618, 616, 715

[56] References Cited

U.S. PATENT DOCUMENTS

| | | | |
|---|---|---|---|
| 4,287,620 | 9/1981 | Zur | 5/615 |
| 4,527,298 | 7/1985 | Moulton | 5/615 |
| 4,873,731 | 10/1989 | Williamson | 5/615 |
| 5,214,812 | 6/1993 | Bartow et al. | 5/602 |
| 5,345,630 | 9/1994 | Healy | 5/615 |

OTHER PUBLICATIONS

*Stryker FirstCare™ Maternity Bed Model 5000 & 5002,* Maintenance Manual, Jan., 1997, Title Page, pp. 123–126.

*Primary Examiner*—Michael F. Trettel
*Assistant Examiner*—Fredrick Conley
*Attorney, Agent, or Firm*—Flynn, Thiel, Boutell & Tanis, P.C.

[57] ABSTRACT

A mattress intended for use with a hospital bed such as a maternity bed. The mattress includes a seat section overlies a complementary seat weldment of the litter of the hospital bed. The seat section includes a perineal end located above the perineal edge of the seat weldment. The seat section of the mattress has a perineal pillow wedge assembly that is positioned below a cushion. The perineal pillow wedge assembly includes a load plate that pivots upwardly relative to the perineal edge of the seat section. A mechanism, such as an inflating bladder, is employed to pivot the distribution plate. The pivoting of the distribution plate compresses the perineal end of the cushion. Consequently, a person lying on the mattress is seated against a relatively hard surface. During the delivery process, this hard perineal end surface functions as the surface against which the mother presses to facilitate the delivery. During post-delivery procedures or other medical procedures, this firm surface provides a relatively hard backing against which the procedures can be performed.

24 Claims, 9 Drawing Sheets

HOSPITAL BED MATTRESS WITH AN ADJUSTABLE FIRMNESS PERINEAL END SECTION

FIELD OF THE INVENTION

This invention relates generally to a mattress for use with a hospital bed and, more particularly, to a mattress with a perineal end section having a firmness that can be selectively set.

BACKGROUND OF THE INVENTION

Over the years, hospital beds have evolved into useful aids for facilitating the performance of various medical procedures. One particular type of hospital bed that has become a useful medical aid is the maternity bed upon which a woman rests while giving birth. A maternity bed includes many of the elements of a conventional hospital bed. The bed has a base that serves as the ground support unit. A litter, located above the base, serves as the support frame for a mattress upon which the woman rests. A maternity bed is further constructed so that the portion of the litter that supports the woman's upper body, referred to as the Fowler weldment, is able to pivot relative to the adjacent section, the seat weldment. A maternity bed is further constructed so that the section of the litter located rearward of the seat weldment, the leg-foot frame, is either removable or retractable. The ability to move the leg-foot frame away from the seat weldment frees the space adjacent the seat weldment so that medical personnel can have easy access to the open end of the birth canal in order to both assist in the delivery of the infant and to perform any necessary post-delivery medical procedures on the mother.

A maternity bed is also often provided with a mattress having one or more sections of adjustable firmness. This is because during the delivery and post-delivery processes, it is desirable to have the mother resting on surfaces having different degrees of hardness. For example, during the initial stages of the delivery process and after delivery, it may be desirable to have the mother resting on a relatively soft mattress. During the actual delivery process, however, it may be preferably to have the mother resting on a harder surface that she can push against in order to facilitate the actual delivery. More specifically, it is desirable to have the mother's perineum, which defines the birth canal, pressing against a firm surface. Also, after delivery, it is desirable to have the mother's perineum seated on a firm surface after delivery in the event there is a need to perform any post-delivery medical procedures on the woman's perineum.

In the past, in order provide a mattress with adjustable firmness for the woman's perineum it has been the practice to simply place an inflatable bladder in the portion of the mattress on which the woman's buttocks rest. This section of the mattress is referred to as the seat section. More specifically, the bladder is sandwiched between two foam cushions that provide the mattress with its form. When there is a need to increase mattress firmness, the bladder is inflated. The inflation of the bladder compresses the cushions to increase the firmness of the seat section of the mattress.

A disadvantage of this current mattress construction is that, while the bladder increases the firmness of the seat section, the increase is mainly in the center of the section. While this increased firmness is useful, it would be more desirable if it was present at the perineal end of the mattress, the end against which the mother's perineum is seated. Moreover, this bladder is loosely fitted in the mattress. It can inadvertently be placed, or shifted, to a position even more distal to the perineal end of the mattress. If this occurs, the increased firmness provided by the bladder may not be a location where it offers any help during the delivery or post delivery processes. If this shifting occurs, medical personnel may not be aware of it until the woman is already resting on the bed. If this is the situation it may be difficult, if not impossible, to reset the bladder so that the expectant mother is able to take advantage of its usefulness.

SUMMARY OF THE INVENTION

This invention is directed to a new and useful maternity bed and mattress designed to facilitate the delivery process for both the mother and medical personnel assisting in the delivery. The bed and mattress of this invention include a perineal pillow wedge assembly. The perineal pillow wedge assembly includes two distribution plates that are hinged together at one end. An inflatable bladder is located between the distribution plates. The assembly is located below the cushions of the seat section of the mattress. The assembly is positioned so that the hinged ends of the distribution plates are located distal from the perineal end of the mattress. The mattress further includes a flexible mattress cover that covers the perineal pillow wedge assembly and the cushions and that is secured to the litter. The bladder is selectively inflated by a compressor mounted to the bed.

When there is a need to increase the firmness of the perineal end of the mattress, the compressor is actuated to inflate the bladder. The inflation of the bladder causes the upper of the two distribution plates to pivot around the associated hinge. The pivoting movement of the distribution plate compresses the cushions between the distribution plate and the mattress cover. This compression increases the firmness of the perineal end of the mattress.

Since the displacement of the upper distribution plate is greatest adjacent the perineal end of the mattress, this is the portion of the mattress that undergoes the most significant increase in firmness. Consequently, the woman's perineum is seated on a relatively firm surface. The static nature of this surface enhances a woman's ability to push against it during the delivery process in order to facilitate the delivery of the infant.

Still another advantage of the mattress of this invention is that the inflation of the bladder serves to raise the overall height of the seat section of the mattress. The rise in this height increases the separation between the seat weldment of the bed and the leg-foot frame of the mattress. The increase in this distance increases the space between the seat weldment and the leg-foot frame to increase the space in which the infant can be delivered when the leg-foot frame is attached to the rest of the bed. Moreover, the inflation of the perineal end of the mattress causes a security pocket to form over the back end of the seat section of the mattress. More particularly, this security pocket is located in the space above the location wherein the seat section of the mattress meets its complementary Fowler section. The upper portion of the woman's buttocks rest in this security pocket. When the Fowler weldment of the litter is adjusted, the woman stays seated in this security pocket. Thus, the likelihood of the woman sliding as the bed is being adjusted is held to a minimum. One advantage of this slide reduction is that it minimizes the extent to which the different components of the bed have to be set in order to be placed in their optimum positions for a particular woman. The minimization of this sliding also minimizes the extent the expectant mother is subjected to potentially disconcerting unintentional and excessive movement during the delivery process.

BRIEF DESCRIPTION OF THE DRAWINGS

The invention is pointed out with particularity in the claims. The above and further advantages of the invention may be better understood by reference to the following detailed description, taken in conjunction with the accompanying drawings, in which:

DETAILED DESCRIPTION

Figure 1:
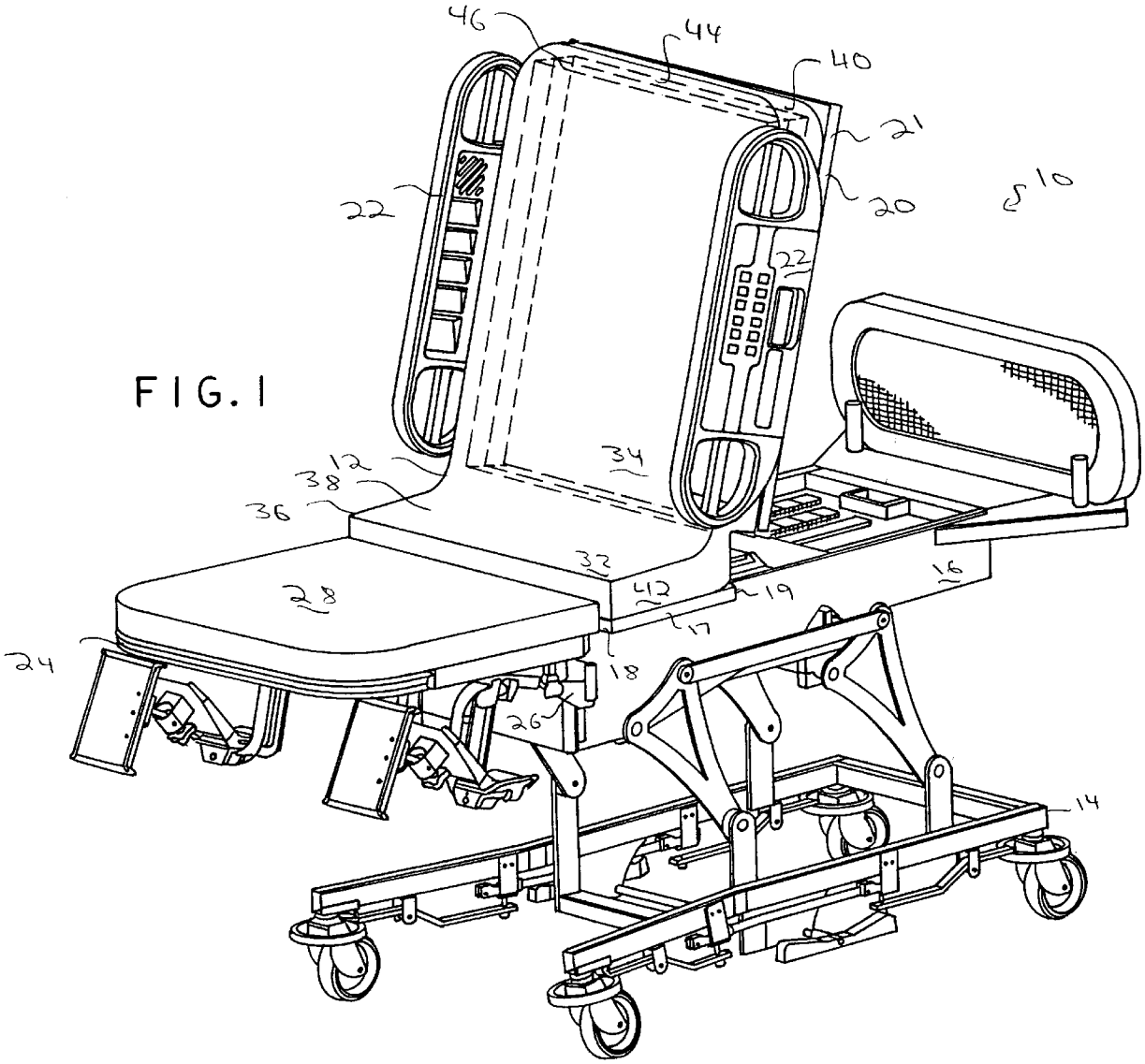
FIG. 1 is a perspective view of a maternity bed incorporating the mattress of this invention.

FIG. 1 illustrates a maternity bed 10 incorporating the mattress 12 of this invention. The bed 10 includes a mobile base 14. A litter 16 is seated over the base 14. A lift assembly, not identified, lifts the litter 16 relative to the base and tilts the litter into what is referred to as the Trendelenburg position. The litter 16 has a fixed seat weldment 17 with a planar top surface. Hereinafter, it should be understood that the end of the seat weldment from which a person's leg extend is referred to as the perineal edge 18. The opposed end of the seat weldment 17 referred to as its back edge 19.

Litter 16 also has a Fowler weldment 20 that is located forward of the seat section 17. The forward end of the Fowler weldment 20 includes a head end 21 on which the patient's head rests. The Fowler weldment 20 pivots relative to an axis that extends laterally across the litter and that is located adjacent the back edge 19 of the seat weldment 17. In some preferred beds, the Fowler weldment 20 is also capable translating movement relative to the seat weldment 17. Side rails 22 attached to the side edges of the Fowler weldment 20 prevent the person on the bed 10 from rolling out of the bed.

A leg-foot frame 24 is removably attached to the litter 16 adjacent the perineal edge 18 of the seat weldment 17. More particularly leg-foot frame 24 is removably attached to a pair of uprights 26 that extend out of the litter 16. The uprights 26 are arranged to travel vertically to allow the height of the leg-foot frame 24 relative to the seat weldment 17 to be adjustably set. A leg-foot mattress 28 is seated on top of the leg-foot frame 24. A more detailed discussion of the components of the base 14, the litter 16 and the leg-foot frame 24 can be obtained from U.S. patent application Ser. No. 08/583,235, filed Jan. 5, 1996, entitled MATERNITY BED, now U.S. Pat. No. 5,774,914, owned by the assignee of this application, which is incorporated herein by reference. The foregoing patent further describes the motors and linkages that cause the various components of the maternity bed 10 to move.

Mattress 12 has a seat section 32 that covers seat weldment 17 and a Fowler section 34 that covers Fowler weldment 20. The mattress 12 includes a single, flexible mattress cover 36 with a unitary top panel 38. Mattress cover 36, including top panel 38, extends from the head end 21 of Fowler weldment 20 to the perineal edge 18 of the seat section 17. Extending downwardly form top panel 38, mattress cover 36 has a first and second rectangular sections 40 and 42, respectively, that are spaced apart from each other. First rectangular section 40 is positioned over the Fowler weldment 20. Second rectangular section 42 is positioned over the seat weldment 17. Inner and outer foam cushions 44 and 46, respectively, shown in phantom, disposed in first rectangular section 40 form the Fowler section 34 of the mattress 12. A bladder, not illustrated, is seated in between foam cushions 44 and 46. This bladder is positioned to be located adjacent the lumbar portion of the person using the bed. When lumbar support is required, this bladder is inflated to provide the support.

Figure 2:
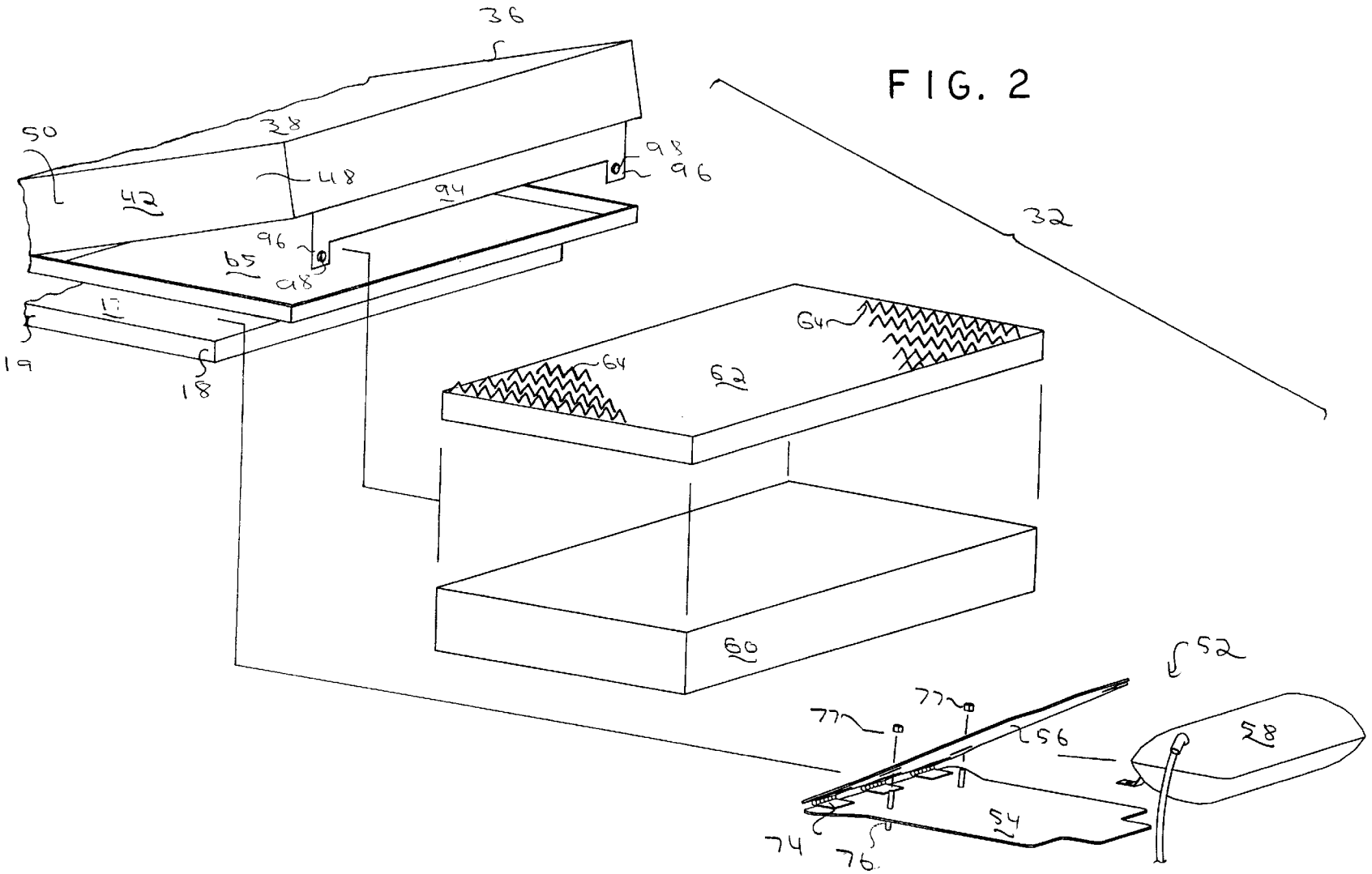
FIG. 2 is an exploded view of the components forming the perineal section of the mattress of this invention.
Figure 3:
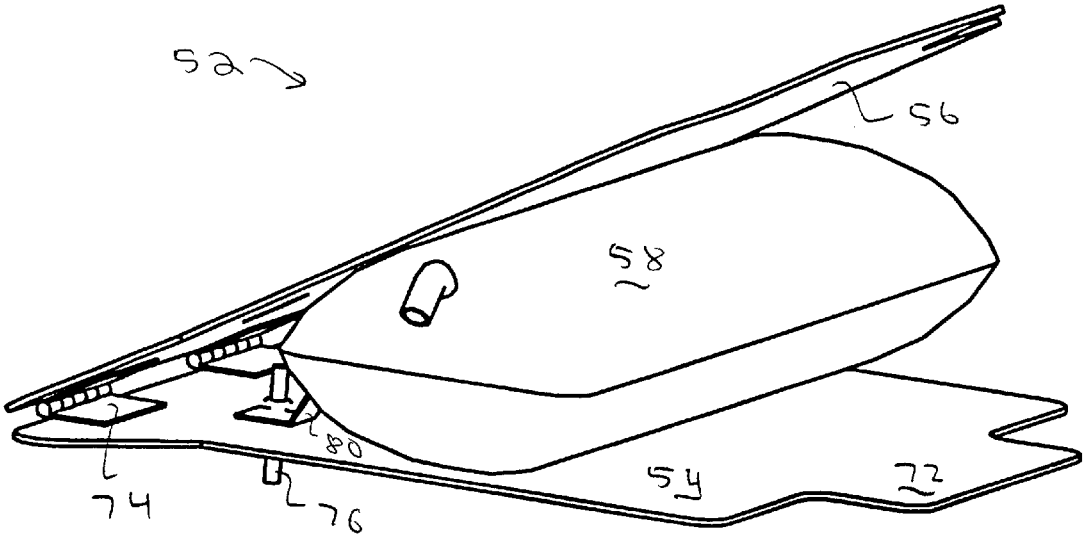
FIG. 3 is a perspective view of the perineal pillow wedge assembly of the mattress of this invention.
Figure 4:
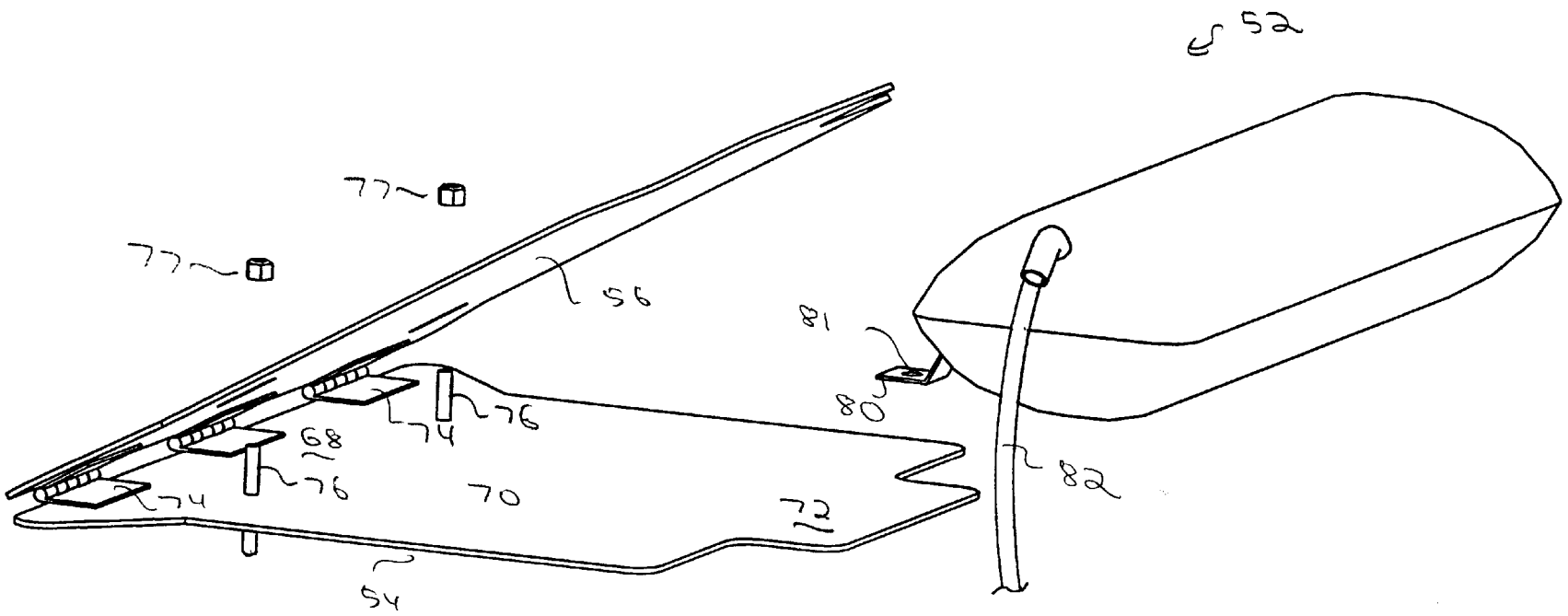
FIG. 4 is an exploded view of the perineal pillow wedge assembly of the mattress of this invention.

The seat section 32 of mattress 12 is now described by initial reference to FIGS. 2–4. The seat section 32 has a perineal end 48 adjacent the perineal edge 18 of the seat weldment 17 and a back end 50 adjacent the back end 19 of the seat weldment. Extending upwardly from the seat weldment 17, seat section 32 includes a perineal pillow wedge assembly 52. The perineal pillow wedge assembly 52 includes a pair of lower and upper distribution plates 54 and 56, respectively. Distribution plates 54 and 56 are hinged together along their rearward edges, that is their edges located towards the back edge 19 of seat weldment 17. An inflatable bladder 58 is located between the distribution plates 54 and 56.

A first, inner cushion 60 is located over upper distribution plate 56. Inner cushion 60 is a 35 ILD polyurethane foam that has density of approximately 2.5 $lb/ft^3$ and is approximately 3 inches thick. A second, outer cushion 62 is disposed over inner cushion 60. Outer cushion 62 is formed from an 80 ILD polyurethane foam that has a density of 1.8 $lb/ft^3$ and is approximately 2 inches thick. In some preferred versions of the invention, outer cushion 62 has raised fingers 64. The perineal pillow wedge assembly 52 and cushions 60 and 62 are covered by second rectangular section 42 of mattress cover 36. Cushions 60 and 62 are disposed inside second rectangular section 42 of mattress cover 36. More particularly it will be noted that second rectangular section 42 is provided with a bottom panel 65 located opposite top panel 38. A zipper, not illustrated, extending around the bottom panel 65 selectively closes the second rectangular section 42.

Figure 4A:
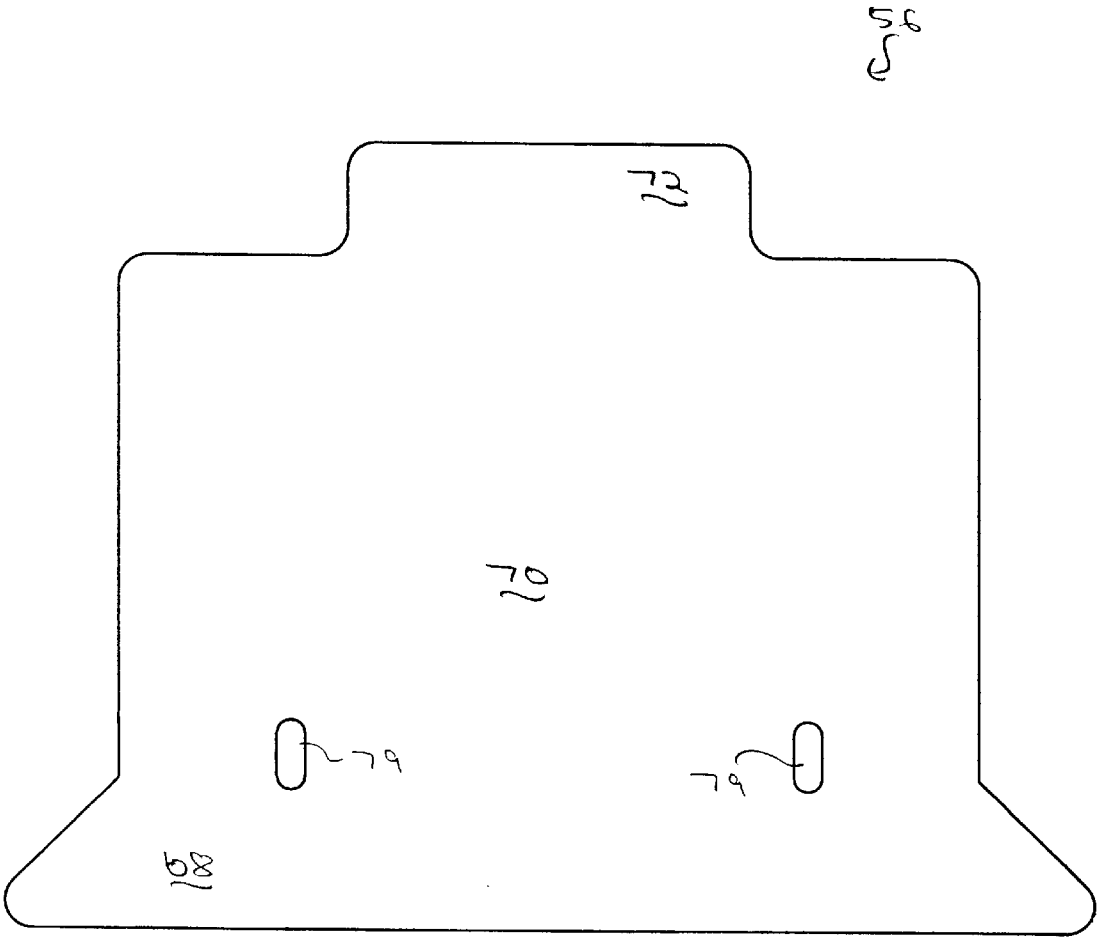
FIG. 4A is a top view of the upper distribution plate of the perineal pillow wedge assembly.

Perineal pillow wedge assembly 52 is described in more detail by reference to FIGS. 3, 4 and 4A. The perineal pillow wedge assembly 52 is seated above bottom panel 65 of mattress cover 36, immediately below inner cushion 60. Each distribution plate 54 and 56 has a relatively wide base section 68 with inwardly tapered side edges adjacent the back edge 19 of seat weldment 17. A main section 70 having a generally rectangular profile extends from the base section 68. A head section 72, with a width less than that of the main section 70, extends forward from the main section towards the perineal edge 18 of the seat weldment 17. The head section 72 forms the leading edge of the distribution plate. In the illustrated version of the invention, three spaced apart hinges 74 secure the rear edges of the base sections 68 of distribution plates 54 and 56 together.

A pair of guide pins 76 are secured to and extend perpendicularly through lower distribution plate 54. Guide pins 76 are secured in place by nuts 77 formed from nylon or other non-metallic synthetic material. The guide pins extend through openings, not illustrated, formed in the bottom panel 65 of mattress cover 36. Upper distribution plate 56 is formed with elongated slots 79, (FIG. 4A) through which the pins 76 extend. Slots 79 are further formed to have sufficient width so that when the plates 54 are pressed together, nuts 77 seat in the slots.

The bladder 58 is formed from a tightly weave, sealed, material such as nylon. A pair of strips 80, one shown, are attached to bladder 58. The end of each strip 80 is provided with an eye-opening 81 to facilitate the securement of the strips 80 to the guide pins 76. An inlet/outlet line 82 is connected one end of the bladder 58. In preferred versions of the invention, bladder 58 has sufficient length so that the end thereof to which inlet/outlet line 82 extends projects outside of the distribution plates 54 and 56. Consequently, when the bladder 58 is deflated and distribution plates 54 and 56 essentially abut, the inlet/outlet line 82 is not compressed closed; air is able to flow through the inlet/outlet line 82 in order to facilitate inflation of the bladder 58.

Figure 5:
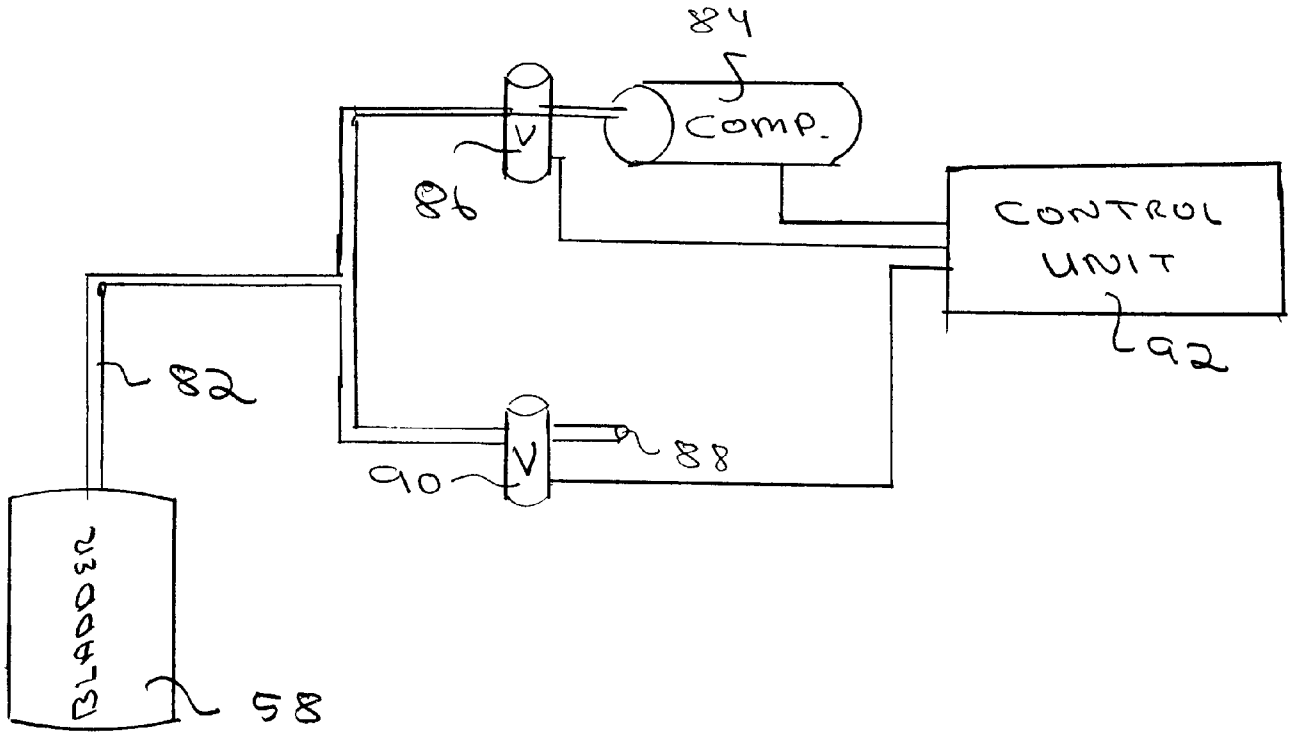
FIG. 5 is a block diagram illustrating the components that control the inflation and deflation of the bladder of the perineal pillow wedge assembly.

FIG. 5 depicts the components employed to regulate the inflation and deflation of bladder 58. The inlet/outlet line 82 of the bladder 58 is connected to an air compressor 84. Air flow from the compressor 84 to the bladder 58 is regulated by a normally closed solenoid-controlled valve 86. Inlet/outlet line 82 is also connected to an outlet port 88. Air flow from bladder 58 to outlet port 88 is controlled by a second solenoid actuated valve 90. Compressor 84 and valves 86 and 90 are contained within litter 16. The on/off state of the compressor 84 and the open/closed states of the valves 86 and 90 are controlled by a control unit 92 in response to the depression of control switches integral with the control unit. In some preferred versions of the invention, valves 86 and 90 are part of a manifold assembly. Also connected to the manifold assembly is an inlet/outlet line through which air is supplied to and discharged from bladder integral with the Fowler section 34 of mattress 12. Additional solenoid-controlled valves which are part of the manifold assembly are opened and closed to regulate the inflation and deflation of Fowler section bladder.

Returning to FIG. 2, it can be seen that a short skirt 94 extends downwardly from the perineal end of the second rectangular section 42 of mattress cover 36. Skirt 94 extends below bottom panel 65. A pair of strips 96 extend downwardly from skirt 94. Each strip 96 is provided with a female snap button 98 that seats over a male snap button 102 (FIG. 6) secured to the undersurface of the seat weldment 17 adjacent perineal edge 18. While not illustrated, similar strips-with-snaps extend down from a back end of the second rectangular section 42. This second set of strips is secured to the undersurface of seat weldment adjacent 17 back edge 19.

The seat section 32 of the mattress 12 of this invention is assembled by positioning bladder 58 between distribution plates 54 and 56. Since the bladder strips 80 are secured to the guide pins 76, the bladder 58 is held in the appropriate position between the distribution plates 54 and 56. The assembled perineal pillow wedge assembly 52 is then placed in the second rectangular section 42 of mattress cover 42. Guide pins 76, which extend through the openings in panel 65, are seated in complementary openings 104 formed in the seat weldment 17 (FIG. 6, one shown) to ensure that the perineal pillow wedge assembly 52 is properly seated on the seat weldment 17.

Once the perineal pillow wedge assembly 52 is properly positioned, cushions 60 and 62 are placed in the mattress cover 36. Mattress cover 36 is then closed. Once the strips 96 are secured to the seat section 17 of the litter 16, the mattress 12 is ready for use.

Figure 6:
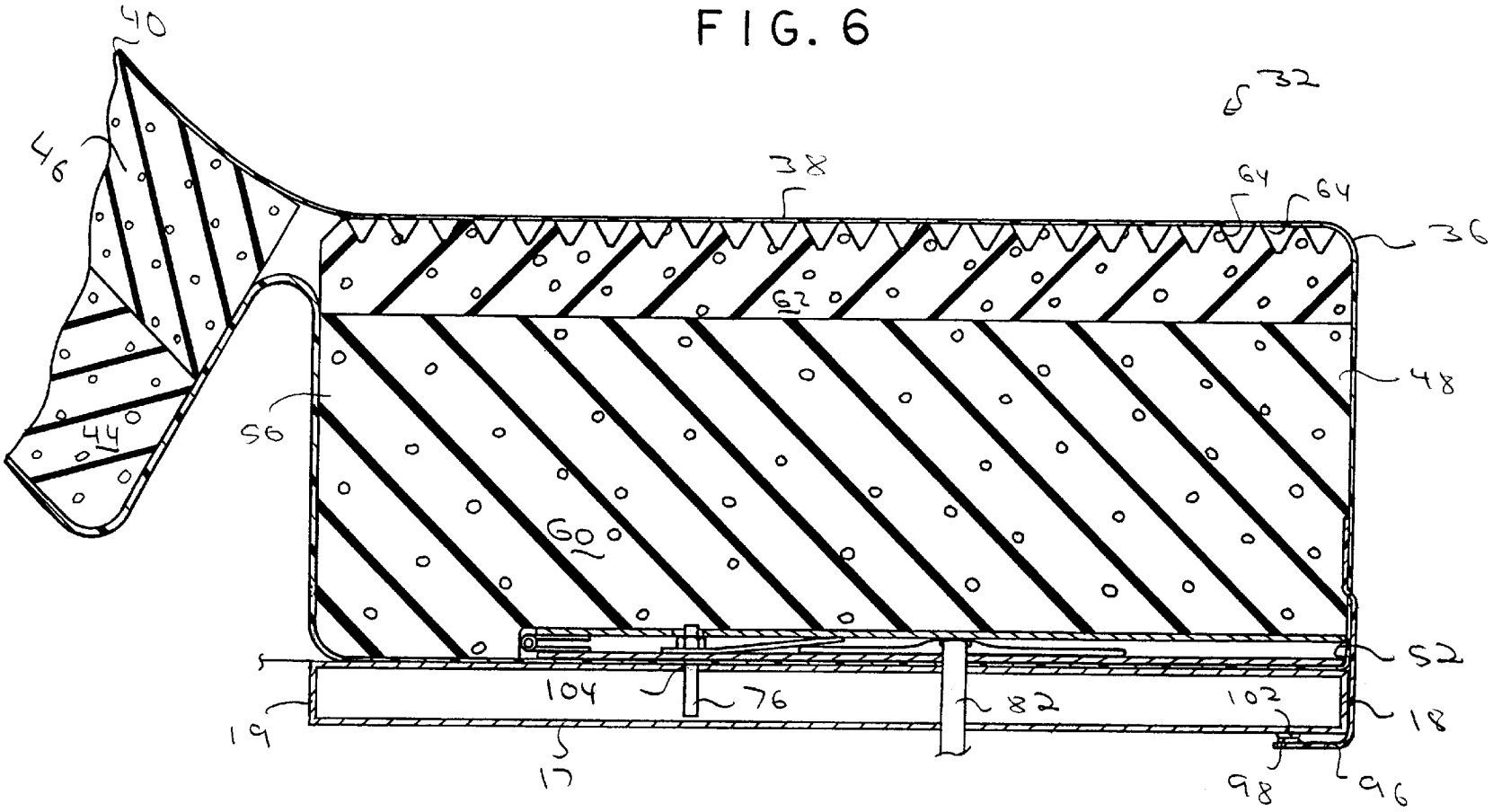
FIG. 6 is a cross sectional view of the seat section of the mattress when the bladder is deflated.

As depicted by FIG. 6, when bladder 58 is in the deflated state, distribution plates 54 and 56 are, for all practical intents, parallel aligned with and abut each other. Consequently, upper distribution plate 56 along the length thereof is equadistally spaced from top panel 38 of mattress cover 36. When the seat section 32 of mattress 12 is in this state, cushions 60 and 62 are in their fully expanded state, and, as such, are in their softest, most compressible state.

Figure 7:
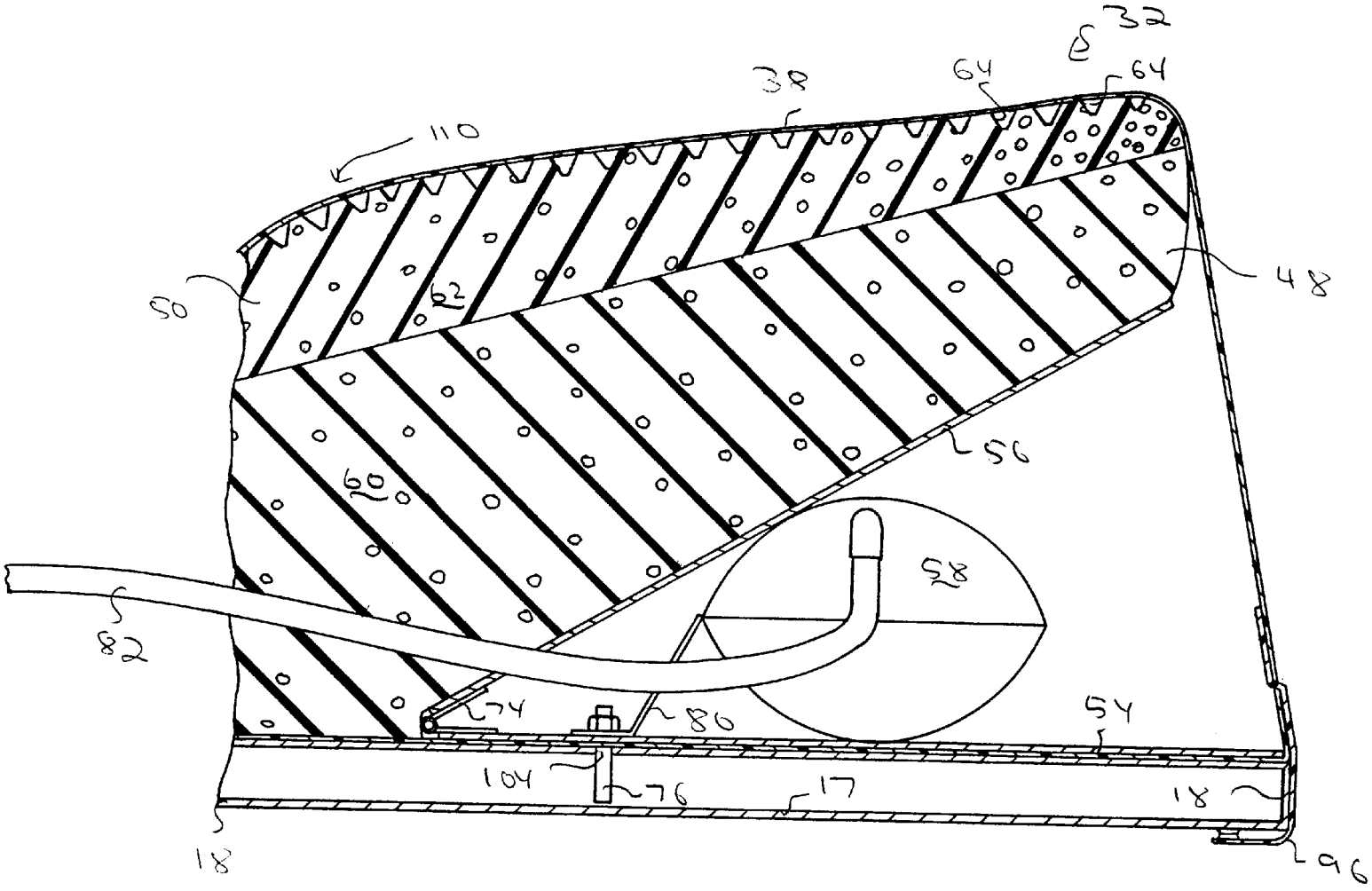
FIG. 7 is a cross sectional view of the seat section of the mattress when the bladder is inflated.

During the later stages of the delivery process, it is desirable to have the expectant mother press her perineum against a relatively hard surface. Once the delivery process enters these stages, bladder 58 is inflated. As depicted by FIG. 7, the inflation of bladder 58 causes upper distribution plate 56 to pivot away from the perineal edge 18 of the seat section 17. Since the secured-in-place cover 36 restricts upward movement of the cushions 60 and 62, the pivoting of distribution plate 56 compresses the perineal end portions of the cushions 60 and 62 between the upper distribution plate 56 and the undersurface of top panel 38. This compression increases the density of the perineal ends of cushions 60 and 62 to increase the firmness of the perineal end 48 of the seat section 32 of mattress 12. The relative firmness of this end of the mattress makes it a good surface for the mother to push against in order to facilitate the delivery of the infant. Moreover, in the event medical personnel are required to perform any post-delivery procedures on the mother, her lower buttocks are resting against a relatively firm surface. This facilitates the ease at which the procedure can be performed.

The inflation of the bladder 58 does more than present a relatively firm perineal end of the mattress 12 against which the mother is able to push. Since the forward portion of the upper distribution plate 56 is the portion that moves the furthest away from seat weldment 17, the perineal end 48 of the seat section 32 rises relative the back end 50. This uneven rise in the seat section causes the seat section define a security pocket 110 above the back end 50 the seat section in which the upper portions of the woman's buttocks rest. The seating of the woman's buttocks in this security pocket 110 serves to limit her movement as the Fowler section 34 of the mattress is positioned with the movement of the Fowler weldment 20. The limitation of this movement prevents the unintended movement of the expectant mother which can increase the time it takes to properly position her in the maternity bed 10 and can possibly be disconcerting to the mother.

Also, the pivoting of upper distribution plate 56 causes the overall elevation of the top panel 38 of the mattress 12 to rise. This rise increases the vertical separation between mattress 12 and leg-foot mattress 28. This separation is desirable when it is desirable for creating an environment that increases the distance between the seat section and the leg-foot mattress 28 of the bed 10.

Figure 8:
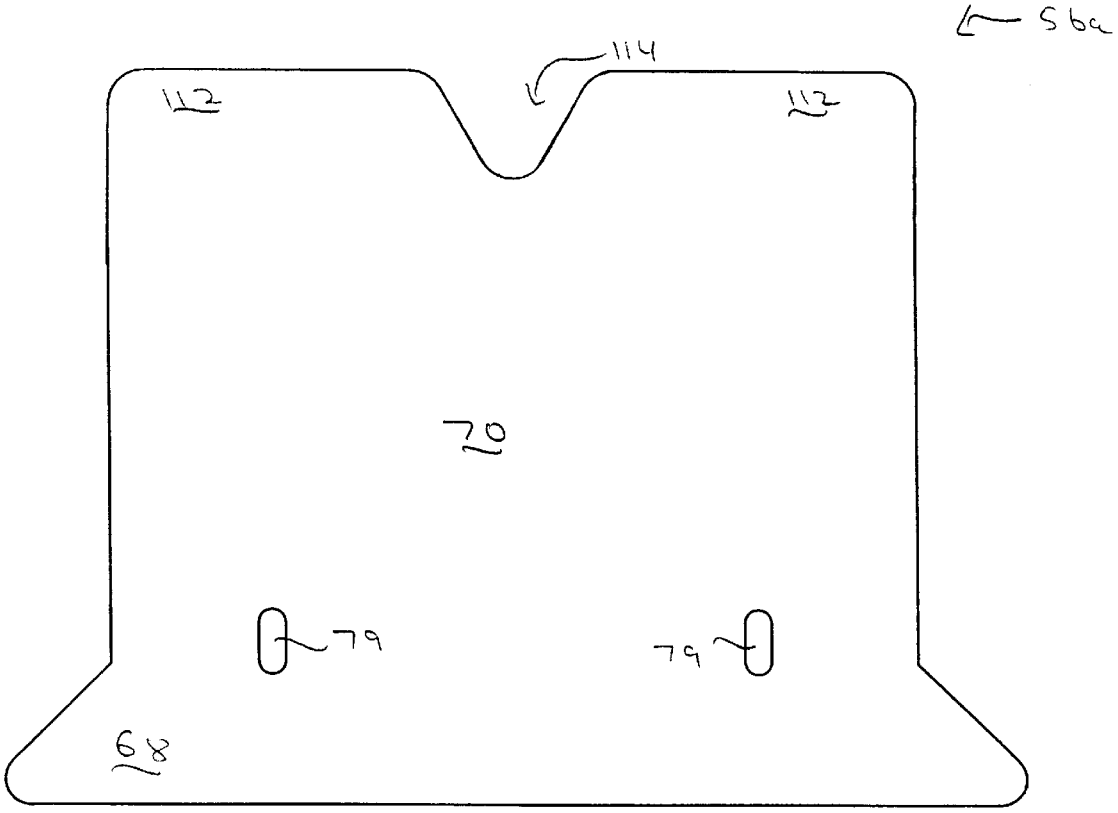
FIG. 8 is a top view of an alternative upper distribution plate of this invention.

It should be recognized that the foregoing description is for the purposes of illustration only and the invention can be practiced with components that are different from those described above. For example, it may be desirable to provide upper distribution plate **56*a* illustrated in FIG. 8. Upper distribution plate 56*a* is formed so that the leading end thereof has two wing sections 112 that define a cutout 114 therebetween. An advantage of this structure is that it ensures that when the plate 56*a*** is in its pivoted state, the firmest sections of the seat section of the mattress are those that underlie where the woman's legs extend from her buttocks. This arrangement further firms the portions of the mattress against which the woman pushes during the delivery process.

Also, in some versions of the invention, the upper distribution plate may be pivotally attached directly to the seat weldment. In these versions of the invention, the bladder may then be located between the seat weldment and the upper distribution plate. Also, the upper distribution plate may be located below the bottom panel of the mattress. Moreover, in still other versions of the invention, the bladder may be eliminated and other mechanisms employed to pivot the upper distribution plate. For example, a rotating eccentric cam may be mounted to the litter 16. When the cam is in a first position, it would not displace the upper distribution plate. As the cam is rotated, it would pivot the upper distribution plate away from the perineal end 18 of the seat weldment 17 so as to cause the desired compression of cushions 60 and 62. In still other versions of the invention, a screw drive or piston may be employed to provide the force needed to pivot the upper distribution plate.

It should similarly be recognized that, in other versions of the bed, there may be no need to secure the mattress cover 36 to the underlying seat weldment 17. In versions of the invention wherein the mattress cover 36 is not secured to the seat weldment 17, the inflation of the bladder 58 as well as the weight of the person resting on the seat section will impose a downward force on the lower distribution plate 54. This force will be sufficient to, in turn, force the lower distribution plate 54 downwardly so that plate 54 holds the bottom of the seat section of the mattress against the seat weldment 17. Consequently, the inflation-induced rise in the bladder does not simply cause the whole of the seat section 32 to rise. Instead, since the seat section 32, the second rectangular section 42 of the mattress cover 36, is vertically held in place, the desired compression of the perineal ends of cushions 60 and 62 takes place. In these versions of the invention, in order to ensure that the seat section does rise, the perineal pillow wedge assembly is typically provided with a lower distribution plate 54 that subtends most of the area subtended by cushions 60 and 62.

Also, the guide pin secured to the perineal pillow wedge assembly 52 can be eliminated and other mechanisms used to releasably secure the assembly to the seat weldment to prevent unintended movement of the assembly. For example, the lower distribution plate 54 can be provided with magnetic strips. Complementary magnetic strips may also be attached to the surface of the seat weldment 17. In these versions of the invention, the magnetic strips hold the perineal pillow wedge assembly in place to prevent unintentional movement of the assembly. An advantage of this arrangement is that it eliminates the need to provide holes in the bottom section 65 of the mattress cover for receiving guide posts.

Still other means may be employed to compress the perineal end 48 of the seat section 32 of the mattress 12 that eliminate the need to provide any distribution plates. For example, it may be desirable to provide a bladder that, when inflated, has a vertical height that is greatest along the perineal edge 18 of the seat weldment 17. This bladder can be a single chamber bladder shaped so its vertical side wall adjacent the perineal edge 18 is greater than the opposed side wall adjacent the back edge 19 of seat weldment 17. Alternatively, the bladder can be a multi-chamber bladder. These bladders could be designed so that the chambers closest to the perineal edge 18 of the seat weldment 17 expand the most when the bladder is inflated. Thus, in these versions of the invention, the bladder itself serves as the displacement member which compresses the perineal ends of cushions 60 and 62 against the mattress cover 36.

Also, it should be understood that not all versions of the bed of this invention may have two cushions. Other versions of the seat section may have one or three or more cushions. Moreover, there is no reason that the perineal end of the seat section 32 of the mattress always have a straight edge. In some versions of the invention, this end of the mattress may have an inward V-cut or an inwardly or outwardly directed curved profile.

Furthermore, while the mattress 12 of this invention is described for use with a maternity bed, its applications are not so limited. Clearly, the mattress of this invention may be incorporated into any hospital bed or surgical/medical table in which its advantages may be of use. Thus, whenever it is desirable to have a patient's groin regions seated against a hard surface to facilitate a medical or surgical procedure, the mattress of this invention may be employed to achieve the desired effect.

Therefore, it is the object of the appended claims to cover all such modification and variations as come within the true spirit and scope of this invention.

The embodiments of the invention in which an exclusive property or privilege is claimed are defined as follows:

1. A hospital bed including:

a base;

a litter disposed above said base, said litter having a head end and a perineal edge distal from the head end; and a mattress disposed over said litter, said mattress extending from the said head end to said perineal edge of said litter, said mattress having:

at least one cushion disposed over said litter, said cushion having a perineal end located adjacent the perineal edge of said litter;

a cover disposed over said at least one cushion and over said litter:

means for restricting vertical movement of said cover relative to said litter so that said cover restricts vertical movement of said at least one cushion relative to said litter;

a displacement member located between said at least one cushion and said litter, said displacement member having a leading edge adjacent the perineal edge of said litter and a rear edge distal from said perineal edge; and an actuator being connected to said displacement member for causing upward movement of said leading edge of said displacement member relative to said rear edge so as to compress the perineal end of said at least one cushion between said displacement member and said cover.

2. The hospital bed of claim 1, wherein said displacement member is a first distribution plate that defines said leading edge and said rear edge and said distribution plate is pivotally attached to said litter along said rear edge.

3. The hospital bed of claim 2, wherein said actuator is an inflatable bladder located between said first distribution plate and said litter.

4. The hospital bed of claim 3, further including a second distribution plate that is located between said first distribution plate and said litter, wherein: said rear edge of said first distribution plate is pivotally secured to a rear edge of said second distribution plate; said second distribution plate is removably secured to said litter; and said bladder is located between said first distribution plate and said second distribution plate.

5. The hospital bed of claim 4, wherein: said litter includes a Fowler weldment that forms said head end of said litter and a seat weldment that forms said perineal edge of said litter; said Fowler weldment is configured to pivot relative to said seat weldment; said mattress includes a Fowler section that covers said Fowler weldment and a seat section that covers said seat weldment; said at least one cushion covers said seat weldment; and said first distribution plate is removably attached to said seat weldment.

6. The hospital bed of claim 4, further including a fastening assembly for removably securing said cover to said litter, said fastening assembly functioning as said means for restricting vertical movement of said cover.

7. The hospital bed of claim 2, wherein: said litter includes a Fowler weldment that forms said head end of said litter and a seat weldment that forms said perineal edge of said litter; said Fowler weldment is configured to pivot relative to said seat weldment; said mattress includes a Fowler section that covers said Fowler weldment and a seat section that covers said seat weldment; said at least one cushion covers said seat weldment; and said first distribution plate is removably attached to said seat weldment.

8. The hospital bed of claim 1, further including a fastening assembly for removably securing said cover to said litter, said fastening assembly functioning as said means for restricting vertical movement of said cover.

9. The hospital bed of claim 1, further including a leg-foot frame that is removably attached to said litter that extends beyond said perineal edge.

10. A hospital bed of claim 8, wherein said fastening assembly includes a first set of snaps attached to said cover and a second set of snaps attached to said litter, said first and second sets of snaps configured to engage each other.

11. A mattress assembly for covering the seat weldment of a bed, the seat weldment having a perineal edge and a back edge distal from the perineal edge, said mattress assembly including:

a first distribution plate having a base for removable attachment to the seat weldment adjacent the back edge and a leading edge located distal from said base adjacent the perineal edge wherein said base is attached to the seat weldment so that said leading edge can pivot relative to the seat weldment;

at least one cushion disposed over said first distribution plate, said at least one cushion having a perineal end adjacent the perineal edge of the seat weldment wherein said leading edge of said distribution plate is located adjacent said perineal end of said at least one cushion;

a flexible cover disposed over said first distribution plate and said at least one cushion;

means for restricting vertical movement of said cover relative to the seat weldment so that said cover restricts vertical movement of said at least one cushion relative to said seat weldment; and a drive mechanism connected to said first distribution plate for pivoting said leading edge of said first distribution plate so that said perineal end of said at least one cushion is compressed between said first distribution plate and said cover.

12. The mattress assembly of claim 11, wherein: a second distribution plate is located between said first distribution plate and the seat weldment; said base of said first distribution plate is pivotally secured to a base of said second distribution plate; and said second distribution plate is configured for removable attachment to the seat weldment.

13. The mattress assembly of claim 12, wherein: said drive mechanism includes an inflatable bladder located between said first and second distribution plates; at least one post is connected to said second distribution plate so as to extend therethrough and into the seat weldment; and said bladder is secured to said at least one post.

14. The mattress assembly of claim 12, wherein said means for restricting vertical movement of said cover includes a fastening assembly for releasably securing said cover to the seat weldment.

15. The mattress assembly of claim 11, wherein said means for restricting vertical movement of said cover includes a fastening assembly for releasably securing said cover to the seat weldment.

16. The mattress assembly of claim 11, wherein a plurality of cushions are located between said first distribution plate and said cover.

17. The mattress assembly of claim 11, wherein said drive mechanism includes an inflatable bladder that is located between said first distribution plate and the seat weldment.

18. The mattress assembly of claim 11, wherein said first distribution plate is shaped so that said leading edge has two spaced-apart wing sections located distal from said base end, said wing sections defining a cutout space therebetween.

19. A hospital bed including:

a litter having a seat weldment with a perineal edge at one end thereof and a back edge at a second end thereof and a Fowler weldment located adjacent said back edge of said seat weldment, said Fowler weldment having a head end distal from said back edge of said seat weldment and being configured to pivot relative to said seat weldment;

a mattress, said mattress having: a Fowler section that covers said Fowler weldment; a seat section that covers said seat weldment, said seat section having a perineal end adjacent the perineal edge of said seat weldment; a cover with a unitary top surface that extends from said head end of said Fowler weldment to said perineal edge of said seat weldment; at least one cushion disposed between said seat weldment and said cover, said at least one cushion having a perineal end located adjacent the perineal edge of said seat weldment; and means for limiting vertical movement of said cover relative to said seat weldment so that said cover limits vertical movement of said at least one cushion; and a perineal pillow wedge assembly disposed over said seat weldment, said perineal pillow wedge assembly including: a first distribution plate located between said seat weldment and said at least one cushion, said first distribution plate having a base end that is removably and pivotally secured to said seat weldment adjacent said back edge and a leading edge located adjacent said perineal edge; and an inflatable bladder located between said first distribution plate and said seat weldment for pivoting said leading edge of said first distribution plate away from said perineal edge of said seat section and towards said top surface of said cover so as to compress the perineal end of said at least one cushion between said first distribution plate and said cover.

20. The hospital bed of claim 19, wherein: said perineal pillow wedge assembly further includes a second distribution plate located between said first distribution plate and said seat weldment; said second distribution plate is removably secured to said seat weldment; said first distribution plate is pivotally secured to said second distribution plate; and said bladder is located between said first and second distribution plates.

21. The hospital bed of claim 20, wherein: at least one post is secured to said second distribution plate and is positioned to seat an opening formed in said seat weldment; said first distribution plate is formed with a slot through which said at least one post extends and said bladder is secured to said at least one post.

22. The hospital bed of claim 19, further including a leg-foot frame that is removably secured to said litter to extend beyond said perineal edge of said seat weldment.

23. The hospital bed of claim 19, wherein said means for restricting vertical movement of said cover includes a fastening assembly for removably securing said cover to said seat weldment.

24. The hospital bed of claim 18, wherein said first distribution plate is shaped so that said leading edge has two spaced-apart wing sections located distal from said base end, said wing sections defining a cutout space therebetween.

* * * * *